United States Patent [19]

Ballestrazzi et al.

[11] 3,991,540

[45] Nov. 16, 1976

[54] PACKAGING MACHINE

[75] Inventors: Aris Ballestrazzi; Lamberto Tassi; Gianni Tosarelli, all of Vignola, Modena, Italy

[73] Assignee: Situmo Holding S.A., Luxemburg

[22] Filed: Sept. 26, 1975

[21] Appl. No.: 617,170

Related U.S. Application Data

[63] Continuation of Ser. No. 149,630, June 3, 1971, abandoned.

[52] U.S. Cl. ..... 53/59 R; 53/182 R

[51] Int. Cl.[2] ..... B65B 57/06

[58] Field of Search ..... 53/58, 64, 72, 30, 182, 53/183, 191, 59 R, 228, 229

[56] References Cited

UNITED STATES PATENTS

| | | | |
|---|---|---|---|
| 3,161,001 | 12/1964 | Grevich et al. | 53/182 |
| 3,228,170 | 1/1966 | Eisenstadt | 53/182 |
| 3,432,981 | 3/1969 | Minten | 53/30 X |

*Primary Examiner*—Travis S. McGehee
*Assistant Examiner*—Horace M. Culver
*Attorney, Agent, or Firm*—Cushman, Darby & Cushman

[57] ABSTRACT

A packaging machine is shown, for various articles, single or multiple, particularly mail, fragile and delicate articles and the like, wherein the article to be packaged is dropped into a partially formed envelope, which is thereafter sealed and severed from the supply of packaging material, any contact of the article with any mechanical gripping device being prevented.

4 Claims, 3 Drawing Figures

BY

INVENTOR.

BY

INVENTOR.

PACKAGING MACHINE

This is a continuation of application Ser. No. 149,630, filed June 3, 1971, and now abandoned.

The present invention relates to a packaging machine for various articles, single or multiple, particularly mail, fragile or delicate articles and the like.

In the known packaging machines, during the packaging process, the article is generally handled, to a greater or lesser extent, by mechanical members, such as grippers, sucking devices and so on, and these machines are not well suited for packaging delicate or fragile articles, or for articles which, due to their conformation, cannot be handled by the aforesaid mechanical devices.

The main aim of the present invention is that of providing a packaging machine which is particularly suitable for packaging fragile or delicate articles.

Thus a packaging machine has been developed which is characterized in that, during the packaging process, the articles are not gripped by any mechanical member.

These and other characteristics and advantages of the present invention will appear from the following description, having illustrative but not limiting meaning, with reference to the annexed drawings, wherein.

Figure 1:
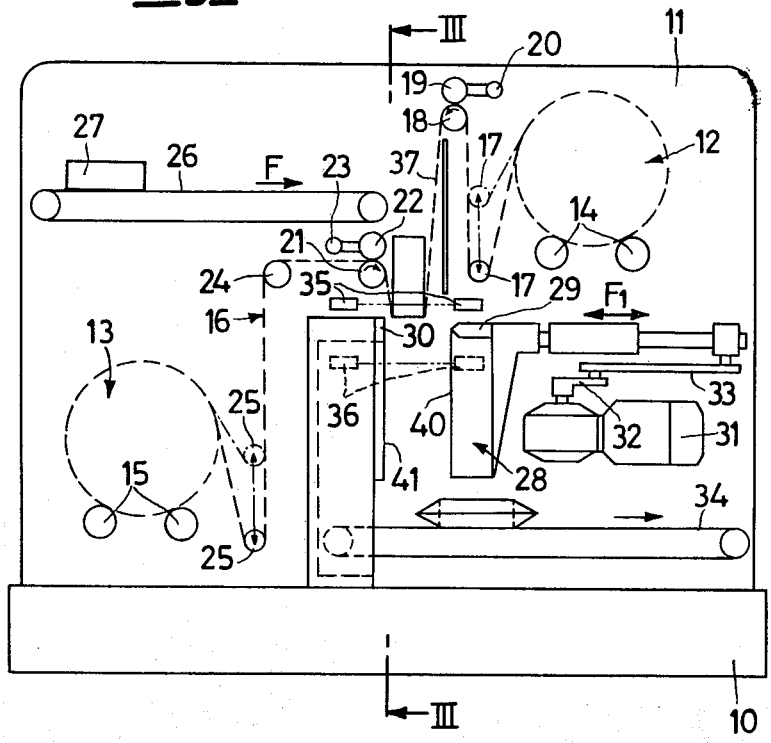
FIG. 1 is a front elevation schematic view of the machine according to the present invention, showing the initial step on packaging an article.
Figure 3:
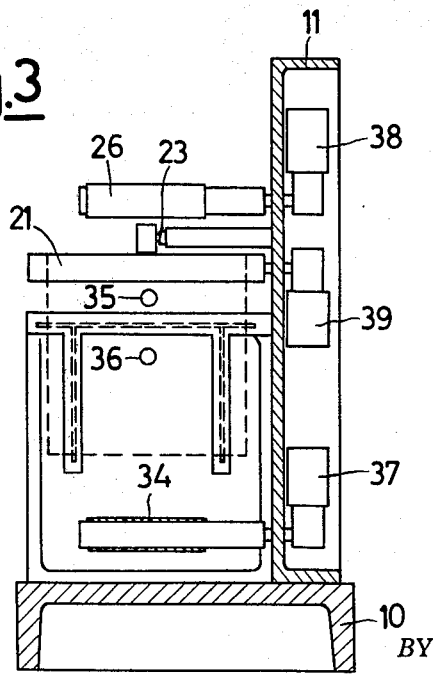
FIG. 3 is a side elevation, partially cross-sectional view, along the line III—III of FIG. 1.

With reference to the drawings, a machine bed is shown comprising a bed plate 10 and a vertical wall 11, all the component parts of the machine being mounted on the machine bed.

Two endless films of a suitable packaging material 16 are unwound from an upper bobbin 12 and a lower bobbin 13, the bobbins 12, 13 being supported in opposed positions by supporting rollers 14, 15, mounted in a cantilevered fashion on the wall 11.

Starting from the bobbin 12 one film of said material 16 is first passed under a tension roller 17, which is vertically movable downward and upward (as indicated by the arrow in FIG. 1), in a manner per se known, and takes up any slack, the material 16 being thereafter passed through the nip formed by a first draw-roller 18 and a counter-roll 19 pivoted at 20; thence the material 16 follows a downwardly directed path and then passes through the nip of a second draw-roller 21, driven by a motor 39, and a counter-roll 22 pivoted at 23, so as to define a cradle shaped length 37, having the function hereinafter fully explained. The second film of material 16 is unwound from the bobbin 13, passing onto a transmission roller 24 and under a tension and slack taking up roller 25, similar to the roller 17.

Above the draw-roller 21 is mounted a feeding belt 26 driven by a motor 38, by which an article 27 to be packaged is fed into the machine. With the reference 28 a package welding and cutting device is generally shown, this device comprising a horizontal upper blade 29 for welding and cutting, welding side blades 40 extending downwardly from the upper blade 29; opposite said blades 29, 40, corresponding counterblades 30, 41, are positioned. The blade 29 and the blades 40 are reciprocally driven in the directions of the arrows $F_1$ from the position of FIG. 1 to the position of FIG. 2 and viceversa by a mechanism, comprising the crank 32 and the connecting rod 33, driven by a motor 31.

A conveyor belt 34, driven by a motor 37, carries the packaged articles away from the machine.

Two pairs of photoelectric cells synchronously control the operation of the machine members, according to the following cycle.

Figure 2:
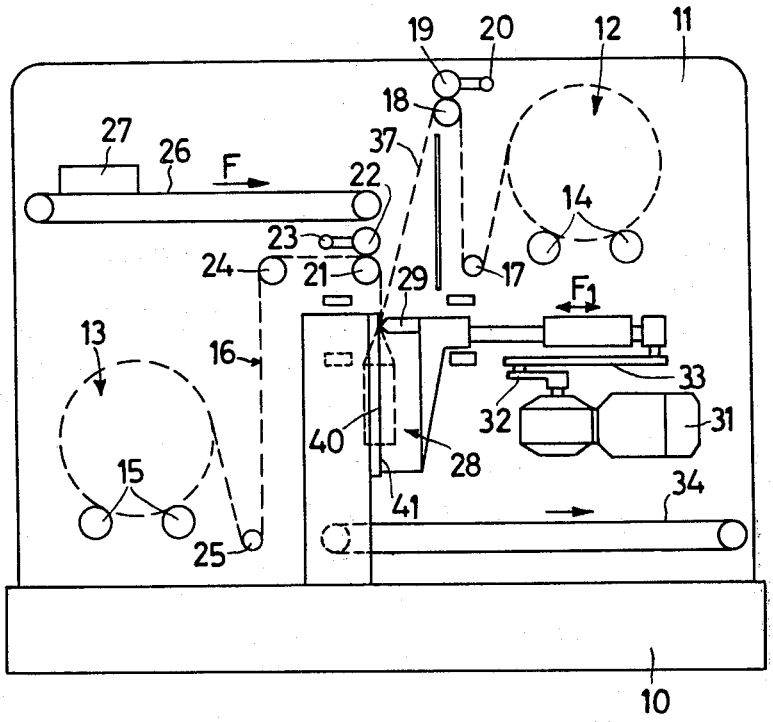
FIG. 2 is a view as in FIG. 1, showing the final packaging step of the same article.

With reference firstly to FIG. 1, the article 27, fed by means of the conveyor belt 26, running in the direction of the arrow F, is dropped in the cradle shaped length 37 of the material 16 between the draw-rollers 18, 21. As clearly shown in the drawings, the article 27 in the loop shaped length 37 intercepts the light beam between the photoelectric cells 35 causing the motion of the feeding belt 26 to stop and actuating the draw rollers 18, 21, which, by rotating in opposite directions (as indicated by the arrows), carry downwardly the packing material along with the article 27.

When the article 27 has completely passed (FIG. 2) the second pair of photoelectric cells 36, the related light beam being no longer intercepted, the rollers 18 and 21 are stopped and the blades 29 and 40, respectively for welding and cutting and for welding, are actuated, these blades sealing the material 16 as a package enclosing the article 27 and severing the package material 16 from the packing material 16 not yet used; the package thereafter falls on the conveyor 34 and is carried out of the machine. The blades 29 and 40 are then returned (by means not shown and well known in the art) to the initial position of FIG. 1, being thus ready for the packaging of another article.

As can be seen, during the packaging process, the article 27 is not handled by any mechanical device such as grippers, sucking devices and the like.

What is claimed:

1. A machine for packaging articles in heat sealable and severable sheet material comprising:

means for rotatably supporting two rolls of the sheet material, driven means for feeding the material from both said rollers to lower a depending loop of the material formed by joined ends of the material from both said rolls, means for successively dropping articles to be packaged into the loop to be supported thereby, first sensing means responsive to the presence of an article supported in the loop for automatically stopping said dropping means and actuating said driven means to lower the loop and the article, said first sensing means being fixedly secured to said machine and being immovable with respect thereto along the path in which said articles are dropped, second sensing means responsive to the lowering of the loop a distance greater, by a predetermined amount, than the height of the article for stopping the driven means and the lowering of the loop, and heat sealing and severing means actuated by said second sensing means and adapted for transverse engagement with the material above the article and longitudinal engagement with the material along the sides thereof at the ends of the article for simultaneously transversely severing the material while seaming it above and below the severance and seaming it along the sides at the ends of the article to enclose the article within the material to form a package while joining the severed ends of the material above the package to form another loop, and wherein the fixing of said first sensing means with respect to said machine to be immovable with respect thereto along the path in which said articles are dropped permits the immediate repeating of the dropping of an article to be packaged into the loop formed by joining the severed ends of the material above the previously formed package.

2. A machine according to claim 1 in which the article dropping means includes an endless conveyor located above the loop.

3. A machine according to claim 1 in which the first and second sensing means comprise photoelectric cells.

4. A machine according to claim 1 including an endless conveyor below the sealing and severing means for receiving the package when the material is transversely severed.

* * * * *